United States Patent [19]

Imai

[11] Patent Number: 4,856,419

[45] Date of Patent: Aug. 15, 1989

[54] PROCESS FOR COLLECTING A CONTAMINATED SUBSTANCE AND APPARATUS THEREOF

[76] Inventor: Takeo Imai, C504, 18-23 Ohmori-Nishi, 2-Chome, Ohta-ku, Tokyo, Japan

[21] Appl. No.: 51,963

[22] Filed: May 19, 1987

[51] Int. Cl.[4] ..... F24F 9/00

[52] U.S. Cl. ..... 98/115.1; 98/36

[58] Field of Search ..... 98/36, 115.1; 126/299 R, 299 D

[56] References Cited

U.S. PATENT DOCUMENTS

| | | | |
|---|---|---|---|
| 2,863,373 | 12/1958 | Steiner | 98/36 |
| 3,708,414 | 1/1973 | Laube | 98/36 X |
| 4,450,756 | 5/1984 | Kling | 98/115.1 |
| 4,552,059 | 11/1985 | Potter | 98/115.1 |

FOREIGN PATENT DOCUMENTS

| | | | |
|---|---|---|---|
| 195227 | 8/1986 | Japan | 98/36 |
| 567035 | 7/1977 | U.S.S.R. | 98/33.1 |

*Primary Examiner*—Harold Joyce

*Attorney, Agent, or Firm*—Schwartz & Weinrieb

[57] ABSTRACT

A process and apparatus for collecting a contaminated substance by means of an upwardly directed suction gas flow caused by a dust collection hood also includes the provision of a downwardly directed air curtain blown out by means of a forced air blower so as to be parallel to the suction gas flow in a counterflowing mode as well as annularly surrounding the upwardly directed suction gas flow and the contamination source. By providing the counterflowing air flows with predetermined relative volume flow rates and velocity flow rates, diffusion of the contaminated substances exteriorly of the downwardly directed annular air flow curtain is effectively prevented.

8 Claims, 3 Drawing Sheets

PROCESS FOR COLLECTING A CONTAMINATED SUBSTANCE AND APPARATUS THEREOF

BACKGROUND OF THE INVENTION

1. Field of the Invention

The present invention relates to an apparatus process for removing air containing contaminated substances, such as, for example, fumes, gases, dust and other harmful constituents generated from any contamination source, and more particularly to a process and apparatus, for collecting such contaminated substances, which is capable of achieving a higher collection efficiency, lower operating costs and smaller size for the treating apparatus.

2. Description of the Prior Art

Dust collection of contaminant substances such as, for example, smoke, fumes, gas, dust, and other harmful constituents is essential in view of the measures for achieving environmental purification and pollution control. Various dust collecting techniques have of course been developed heretofore.

Among these techniques, the most popular one is a process in which the contaminated substances are collected by suction through means of a dust collection hood. This process is based upon the technique of sucking and removing generated contaminants through means of a the dust collection hood installed opposite to or within the vicinity of the contamination source. However, in order to achieve complete purification by means of this process, it is inevitable that surrounding surplus air is sucked-in in a large quantity, thus leading to an increased volume of air to be treated.

To resolve this problem, there has been proposed a process which is intended to prevent the diffusion of air flow by installing an air supply manifold which opens toward a dust collection hood and which sucks in contaminated substances together with an air flow exhausted from such manifold. While this process can achieve a high dust collection efficiency, it has difficulty in adjusting the width of the exhausted air flow. In a particular application of this process in which the dust collecting speed depends upon the type and kind of contamination source, such a process may in fact promote the diffusion of the contaminated substances, owing to such poor width adjustment of the exhausted air flow, rather than preventing such diffusion of the contaminating substances.

OBJECTS OF THE INVENTION

One object of the present invention is to provide a process and apparatus which is capable of sucking in the air containing the contaminated substances without external diffusion of the contaminated substances with respect to its source, and which is capable of reducing the suction of surplus air whereby lower operating cost can be achieved.

Another object of the present invention is to provide an apparatus and process in which the volume of the air flow to be treated can be reduced to one-half or less as compared with conventional dust collection hood systems, whereby the apparatus can be made so as to have a relatively smaller size.

Still another object of the present invention is to provide a dust collecting process and apparatus which is capable of collecting and exhausting the air containing the contaminated substances generated from contamination sources, such as, for example, an electric furnace, tunneling site and loading place for various kinds of powders or grains.

SUMMARY OF THE INVENTION

Such objects of the present invention can be achieved by surrounding the suction gas flow containing the contaminated substances with an air curtain blown out in a direction opposite that of the suction gas flow and with predetermined volume and velocity flow rates.

BRIEF DESCRIPTION OF THE DRAWINGS

Various other objects, features, and attendant advantages of the present invention will be more fully appreciated by reference to the following detailed description, when considered in connection with the accompanying drawings, in which like reference characters designate like or corresponding parts throughout the several views, and wherein.

DESCRIPTION OF THE PREFERRED EMBODIMENTS

Figure 1:
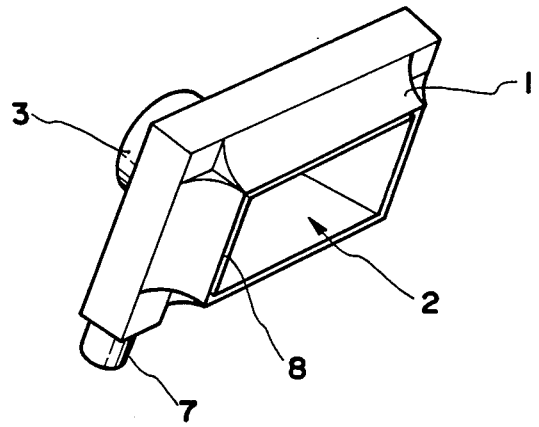
FIG. 1 is an oblique perspective view showing one embodiment of the apparatus of the present invention.
Figure 2:
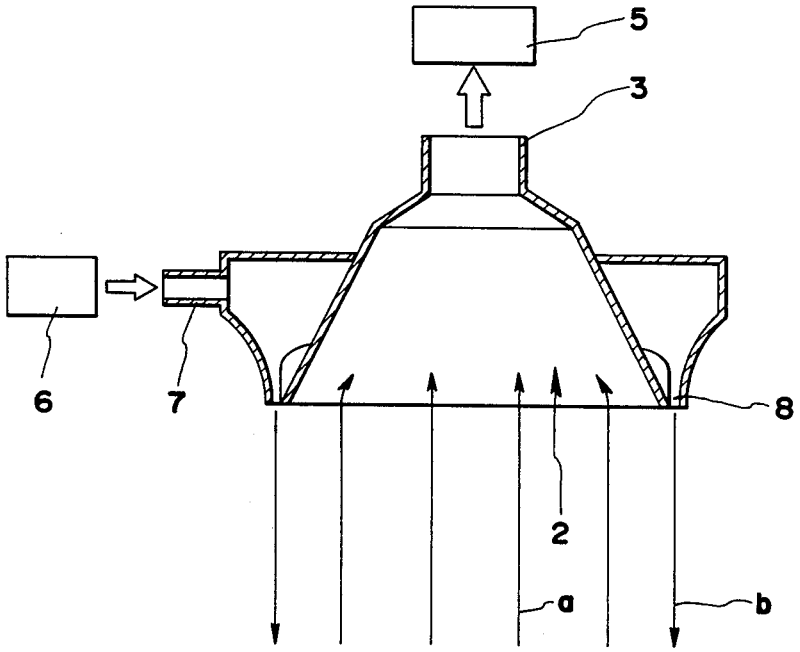
FIG. 2 is a side sectional view of the apparatus shown in FIG. 1, FIGS. 3 and 4 are explanatory oblique views showing the use of the apparatus of FIGS. 1 and 2 in two different operational modes.

In FIGS. 1 and 2, a hood body 1 having a rectangular opening 2 is connected at its base to a suction blower 5 which communicates through means of a discharge pipe 3 with dust treatment equipment (not shown). Around the opening 2 in the dust collection hood, a slit-like air outlet 8 communicating with a forced blower 6 and an air intake pipe 7 is provided.

In operation, therefore, a counter air flow system consisting in combination of an upwardly directed negative pressure flow a of contaminated substances sucked in at the opening 2 by means of the suction blower 5, and a downwardly directed air curtain b blown out by means of forced blower 6, air intake pipe 7, and annular air outlet 8, so as to be disposed substantially parallel to air flow a in an annularly surrounding manner, is formed as is shown in FIG. 2.

Figure 3:
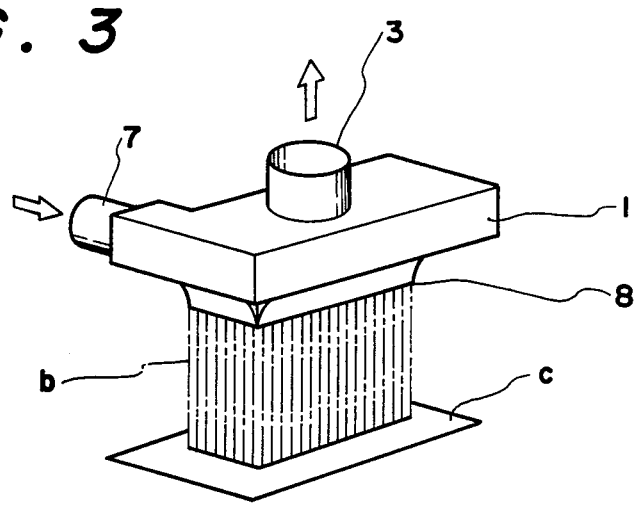
Figure 4:
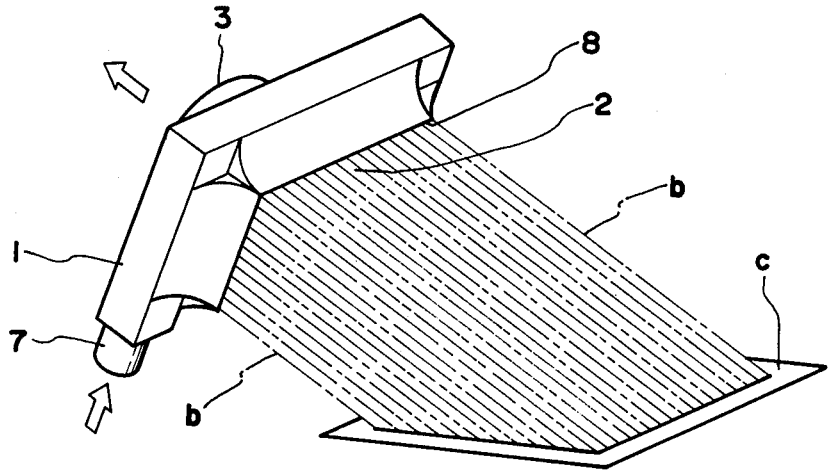

The dust collection hood is installed so as to ensure that the air curtain b may surround a contamination source c vertically or obliquely as is shown in FIGS. 3 and 4.

In general in the case of the blowout or positive exhaustion of air flow, the velocity v of air blown out from a circular nozzle having a diameter D is reduced to 1/10 the value of v at a distance corresponding to 30 times as long as D. In the case of suction of air, the distance at which the velocity v of the air flow is reduced to 1/10 is nearly equal to the hood diameter.

However, the discharging or collecting conditions of contaminated substances vary widely depending upon the ambient conditions or factors, as is shown in Table 1.

TABLE 1

| Discharging conditions of contaminated substances | Example | Collecting velocity v (m/s) |
|---|---|---|
| Discharging into still air without dispersion. | Dissolution of oil and fat evaporated from tank. | 0.3 to 0.5 |
| Discharging into comparatively still air at low speed. | Spray booth, welding, plating and pickling | 0.5 to 1 |
| Discharging into quick air flow at comparatively high speed. | Spray coating in an elongated booth, conveyor and crusher | 1 to 3 |
| Discharging into very quick air at high speed | Grinding, polishing blast tumbling | 3 to 10 |

In consideration of these physical phenomena and the discharging conditions of contaminated substances, in accordance with the present invention, the first, downwardly directed air curtain b, forming an air system annularly surrounding the contamination source c, should be blown out at a flow velocity of 15 m/s or more and with a volume flow rate within the range iof about 1/10 to ½ that of the second upwardly directed air flow a which is disposed internally within the annularly surrounding air curtain b, whereby the contaminated substances are removed from the contamination source c. Moreover, it is desirable to form a combined air flow zone of counterflowing air flows wherein the air curtain b has a flow velocity equal to that of the surface air flow velocity of the second upwardly directed air flow a on the hood 1 when the hood 1 is disposed at close range to the contamination source.

In determination of the flow rate of the air curtain b, the following formulas can be utilized.

Assuming that the air flow velocity of annular air curtain b is Vr(m/s), the air outlet width is D (m), the air outlet length is L (m), the air outlet flow velocity: Va (m/s), the blow-out angle is $\theta°$, and the distance from the air flow outlet to the contamination source is l (m), then $$Vr = \sqrt{(2 \times Va^2 \times D \times \mathrm{Sin}2\theta)/l} \quad [m/s]$$

The quantity of blown out air is:

$$Q = Va \times D \times L \times 60 \quad [\mathrm{m}^3/\mathrm{min}]$$

The quantity of air at any l (m) position is:

$$Ql = 0.552 \times \sqrt{l/D} \times Q \; [m^3/\mathrm{min}]$$

By establishing the aforenoted volume flow rate and velocity flow conditions of the first downwardly annular fluid curtain and the second upwardly directed suction fluid flow, and in view of the fact that the downwardly directed annular air curtain completely surrounds the contaminated substance source, part of the downwardly directed annular flow curtain is sucked back upwardly, along with the contaminated substance, by means of the upwardly directed suction flow. In this manner, diffusion of the contaminated substance outside of the downwardly directed annular air curtain is effectively prevented.

Figure 5:
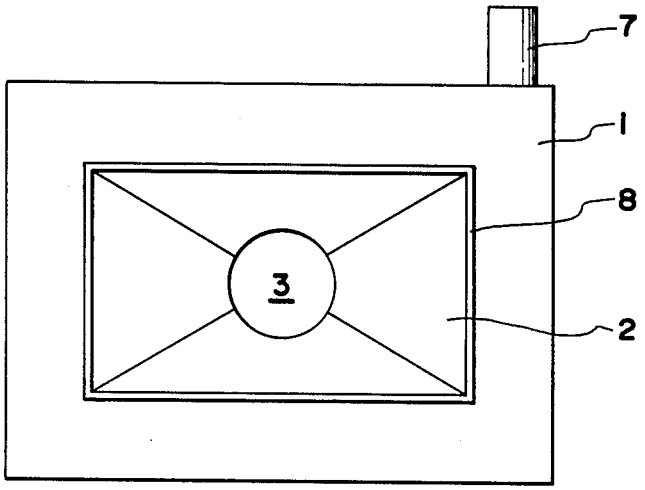
FIGS. 5 and 6 are bottom views showing the structural examples of dust collection hoods.
Figure 6:
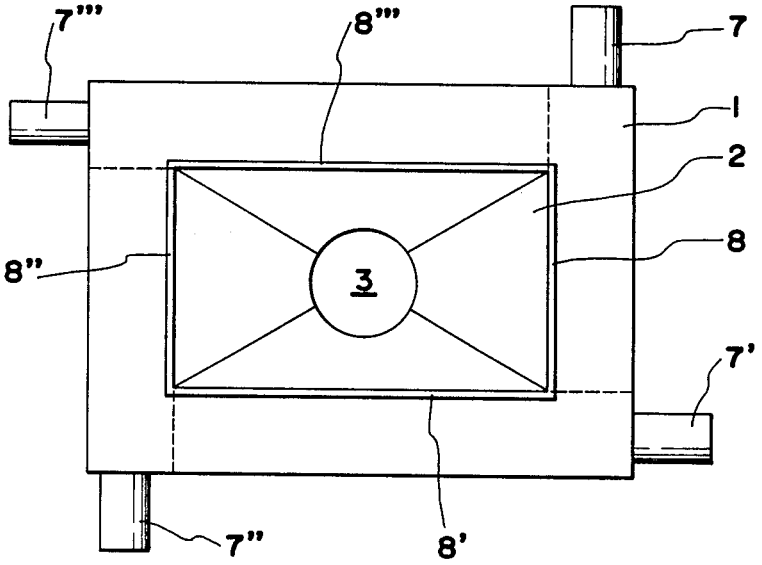

In addition, it is also to be noted that the downwardly directed, blown out air curtain may be formed either as an air flow of uniform velocity or as an air flow of having a velocity which changes with the surrounding position. In the case when the air flow of uniform velocity is to be formed, the inside of hood body 1 is not divided into compartments as shown in FIG. 5, but the dust collection hood is designed to be of such construction that the air supplied from the air intake pipe 7 may be blown out as an air curtain having a uniform velocity from the slit-like annular air outlet 8. In the case when the air flow having a velocity which changes with the surrounding position, the inside of hood body 1 and slit-like air outlet 8 communicating therewith are divided into a plurality of compartments indicated by 8, 8', 8'' and 8''' as shown in FIG. 6, and the air of different supply pressures is introduced into air intake pipes 7, 7', 7'' and 7''' which branch off from the forced blower 6 and are installed for the respective compartments. By changing the flow velocity of the annular air curtain as a function of the surrounding position, the density of the air flow constituting the air curtain can be controlled according to the degree of contaminated substance generation.

As mentioned above, according to the process and apparatus of the present invention, the air fluid containing contaminated substances, such as, for example, fumes, gases, dust and other harmful constituents can be removed by suction without external diffusion from its source and the volume of air to be treated can be reduced to one half or less as compared with the conventional techniques, thus leading to the realization of operation at significantly reduced operating costs. When applied to dust removal in connection with an electric furnace for example, the working environment around the furnace can be improved significantly. Moreover, as compared with the case when the conventional type dust collection hood is used, the treating time for the generated dust can be remarkably shortened and electric power for the dust collecting fan in the building can also be conserved.

Obviously, many modifications and variations of the present invention are possible in light of the above teachings. It is therefore to be understood that within the scope of the appended claims, the present invention may be practiced otherwise than as specifically described.

What is claimed is:

1. Apparatus for collecting a contaminated substance issuing from a contamination source, comprising:

means for forming a first annular air current which is directed downwardly toward said contamination source so as to annularly surround said contamination source;

means for forming a second suction air current interiorly within said first annular air current and directed upwardly away from said contamination source so as to remove contaminated substances from said contamination source;

a hood;

means defining separate compartments within said hood;

annular slot means defined within a peripheral portion of said hood for defining an outlet path for said first annular air current;

an upstanding conical duct defined radially inwardly of said annular slot means for defining an outlet path for said second suction air current; and means defining separate air exit slots within said annular slot means and respectively connected to said separate hood compartments for providing exiting air currents comprising said first annular air current having different flow velocities at different locations relative to said contamination source.

2. Apparatus as set forth in claim 1, wherein:

said hood has a substantially rectangular configuration; and each of said compartments and said air exit slots extends substantially the entire length of one side of said rectangularly shaped hood.

3. The apparatus as set forth in claim 1, wherein:

said first annular air current means comprises a forced air blower.

4. The apparatus as set forth in claim 1, wherein:

said second suction air current means comprises a suction blower.

5. Apparatus as set forth in claim 1, wherein:

said conical duct and said annular slot means are coaxially disposed with respect to each other.

6. Apparatus as set forth in claim 5, wherein:

said second suction air current means comprises a suction blower coaxially disposed with respect to said conical duct and said annular slot means, and downstream of said conical duct.

7. Apparatus as set forth in claim 1, wherein:

said first annular air current means comprises a forced air blower fluidically connected to a peripheral portion of said annular slot means so as to introduce forced air into said annular slot means in a direction substantially perpendicular to the outflow of said forced air from said annular slot means.

8. Apparatus as set forth in claim 1, further comprising:

a plurality of intake pipe means respectively connected to said separate compartments within said hood for providing said first annular air current to said separate compartments.

* * * * *